United States Patent [19]

Nunn

[11] Patent Number: 4,793,546

[45] Date of Patent: Dec. 27, 1988

[54] BOX

[75] Inventor: Gary L. Nunn, Eaton, Ohio

[73] Assignee: Color-Box, Inc., Richmond, Ind.

[21] Appl. No.: 114,953

[22] Filed: Oct. 30, 1987

[51] Int. Cl.[4] ..... B65D 5/06; B65D 5/36

[52] U.S. Cl. ..... 229/109; 229/110; 229/122; 229/41 C

[58] Field of Search ..... 229/109, 108, 110, 122, 229/41 C

[56] References Cited

U.S. PATENT DOCUMENTS

| | | | |
|---|---|---|---|
| 2,174,687 | 10/1939 | Comley | 229/41 C |
| 2,707,586 | 5/1955 | Buttery | 229/41 C |
| 2,925,213 | 2/1960 | Zukoski | 229/41 C |
| 4,015,767 | 4/1977 | Ferriter | 229/41 C |

FOREIGN PATENT DOCUMENTS

| | | | |
|---|---|---|---|
| 117701 | 5/1930 | Austria | 229/41 C |

*Primary Examiner*—Willis Little

*Attorney, Agent, or Firm*—Biebel, French & Nauman

[57] ABSTRACT

An eight-sided box having uninterrupted top and bottom walls, which can be inexpensively manufactured as a single sheet of corrugaed cardboard and shipped in a flattened, knock-down configuration with the manufacturer's joint formed, and which can be quickly erected, filled and closed by a packager to provide a secure package. In a second embodiment locking ears are provided which virtually insure that the box cannot be inadvertently opened.

18 Claims, 4 Drawing Sheets

BOX

BACKGROUND OF THE INVENTION

While a number of polygonally-shaped boxes are well-known in the prior art, as exemplified by U.S. Pat. Nos. 1,892,715; 2,156,999; 2,174,687; 2,314,631; 2,319,974 and 2,819,833, each of them either sacrifices ease of assembly for integrity of construction or, while providing a construction of substantial reliability, requires an interlocking assembly of components that is difficult and time-consuming to interconnect during erection and closure of the box.

Therefore, while as noted, multi-sided box constructions have been well-known in the prior art for many decades, none satisfies the criteria of sturdiness, inexpensiveness of manufacture and ease of erection.

SUMMARY OF THE INVENTION

The present invention provides a multi-sided box construction which can be inexpensively manufactured as a one-piece blank, provided with a manufacturer's joint, shipped in a knocked-down configuration to a packager, and quickly and easily erected, filled and closed to provide a sturdy one-piece, multi-sided box assembly.

Thus, the box of the present invention is preferably stamped from a sheet of corrugated cardboard or the like, which is particularly suited for packaging relatively fragile, but often heavy objects, such as glassware, to provide a package which insures against inadvertent separation of the box components and consequent damage or destruction of its contents.

In one preferred embodiment of the invention the box comprises eight-sided top and bottom walls, rectangularly-shaped wall panels joined to the top and bottom walls along opposite edges thereto, trapezoidally-shaped wings intermediate the points of attachment of the side walls to the top and bottom walls, locking tabs and complementary locking slots and a glue flap on a top wall which can be secured to an inner surface of one of the box wall panels.

With this configuration the manufacturer's joint is formed between the glue flap and a wall panel, the resulting, partially assembled box shipped in a flattened condition to a packager, and then erected by displacing the top and bottom walls from their flattened condition to a position in which the top and bottom walls are substantially aligned with each other, the wings and side walls at one end of the box folded inwardly, and the locking tab at that end inserted into its complementary locking slot, the partially assembled box turned on end, the goods to be packaged inserted therein, and the remaining end then folded inwardly in exactly the same fashion as the first end of the box.

In a second preferred embodiment of the invention the construction is substantially the same as that described above and its assembly, erection, filling and closing is substantially the same as those operations are described above, but additional locking ears are provided which interlock and provide additional insurance against inadvertent loss of the box contents.

These and other advantages and features of the present invention will become more readily apparent from the following detailed description.

BRIEF DESCRIPTION OF THE DRAWINGS

FIGS. 12 and 13 illustrate the erection and closure of the box of the second preferred embodiment.

DESCRIPTION OF THE PREFERRED EMBODIMENTS

Figure 10:
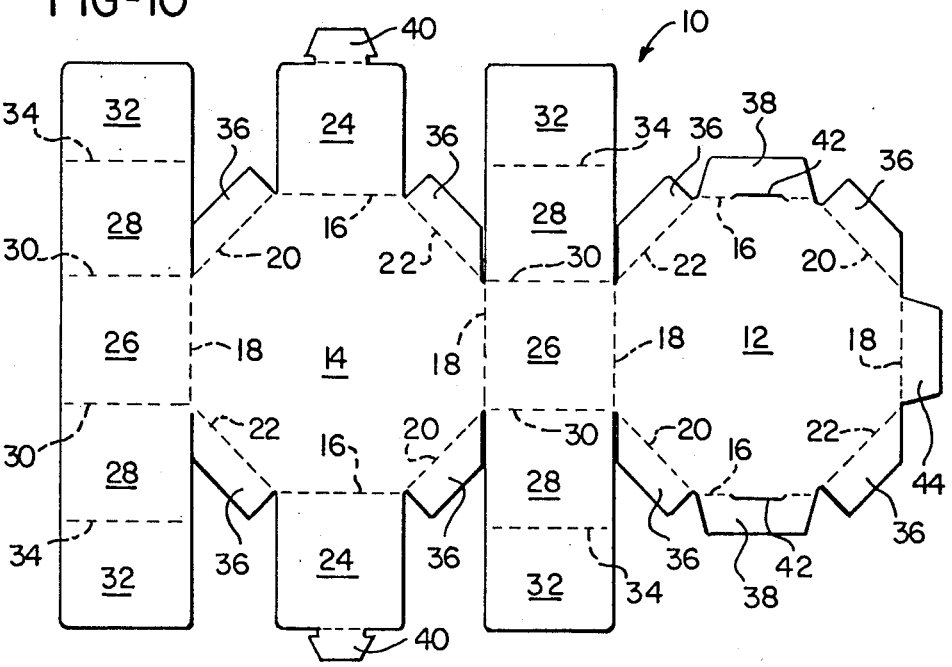
FIG. 10 shows the blank from which the box of FIGS. 1 through 8 is constructed.

With reference initially to FIG. 10 of the drawings, it will be seen that the box 10 of the present invention can be formed integrally from a sheet of corrugated cardboard, with the box blank comprising substantially identical, polyganal top and bottom walls 12 and 14, which in the embodiment shown include eight sides, including a first opposing pair of sides 16, a second pair of opposing sides 18 and a third and fourth opposing pairs of sides 20 and 22, respectively.

The box shown consists of eight sides, and it is important in the context of the present invention that in order to obtain the constructional advantages of the present design the box contain eight or more sides with the total number of sides when divided by two equaling an even number, e.g. eight, twelve, sixteen, etc.

A first pair of substantially rectangular wall panels 24 are joined along their inner edges to the first opposing sides 16 of the bottom wall 14, and a second pair of wall panels 26 of substantially the same size and shape as the wall panels 24 are joined along their inner edges to the second opposing sides 18 of the bottom wall 14.

Third pairs of substantially rectangular wall panels 28 are joined along lateral edges 30 thereof to corresponding lateral edges of the second wall panels 26, and fourth pairs of wall panels 32 are joined along inner edges 34 thereof to corresponding outer edges of said third pairs of wall panels 28. Each of the wall panels 24, 26, 28 and 32 are of substantially the same size and shape.

Substantially trapezoidally-shaped wings 36 are joined along their major bases to the sides 20 and 22 of the top and bottom walls 12 and 14, and substantially trapezoidally-shaped extensions 38 are joined along their major bases to the first opposing pair of sides 16 of the top wall 12. The first pair of wall panels 24 are provided with locking tabs 40 and slots 42 are formed along the first opposing pair of sides 16 of the top wall 12 complementary to the locking tabs 40. Lastly, a glue flap 44 of substantially trapezoidal-shape is joined to the top wall 12 along the outer one of its second opposing sides 18.

Figure 1:
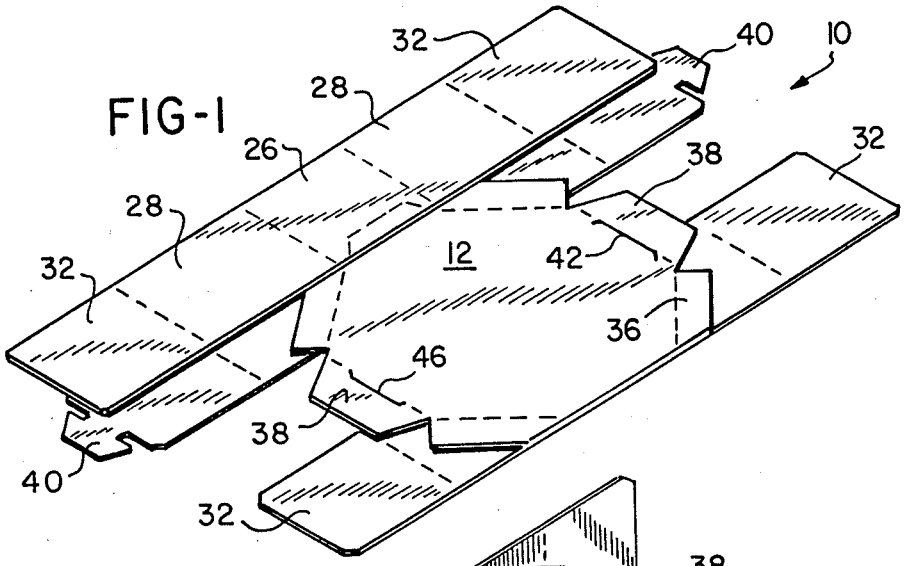
FIG. 1 is a perspective view of one embodiment of the present invention in the knocked-down configuration.
Figure 9:
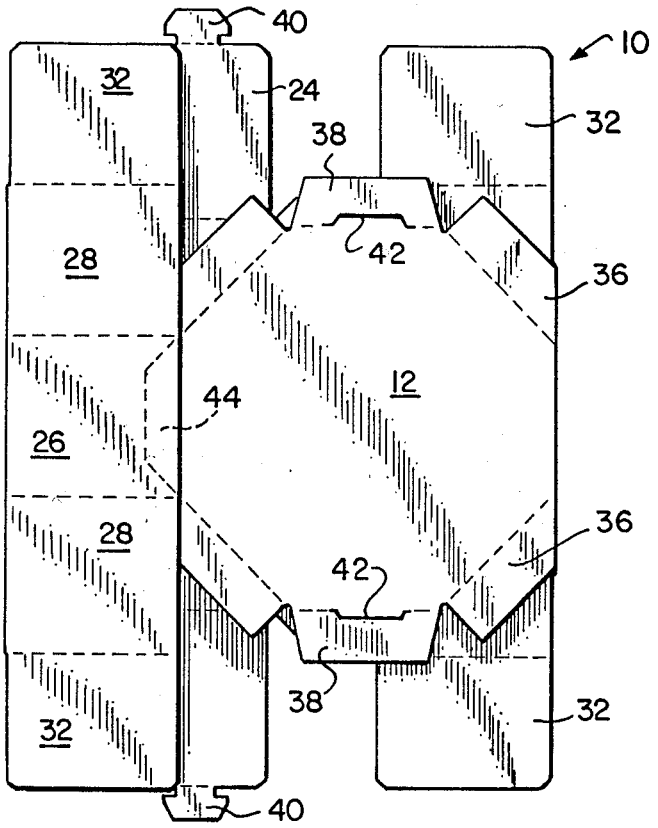
FIG. 9 is a plan view showing the box of FIG. 1 in the knocked-down configuration.

With this construction the box is initially folded along the line joining the top wall 12 to a side wall panel 26 and a second line joining the bottom wall 14 to an opposing side wall panel 26 to the configuration shown in FIGS. 1 and 9 of the drawings and the glue flap 44 is adhesively secured to an inner surface of the overlying side wall panel 26 to form a so-called "manufacturer's joint".

Figure 2:
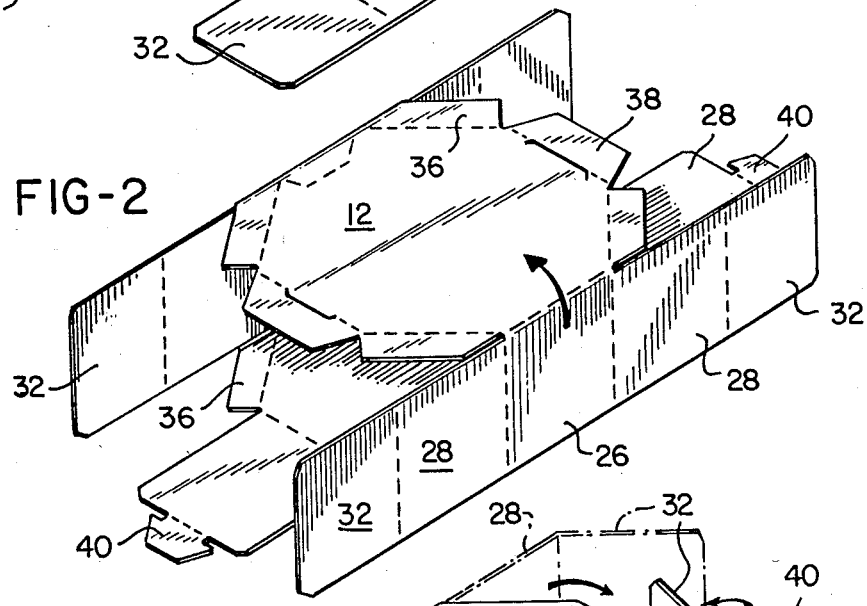
FIG. 2 is a view similar to FIG. 1, but showing the box erected in a first stage.
Figure 3:
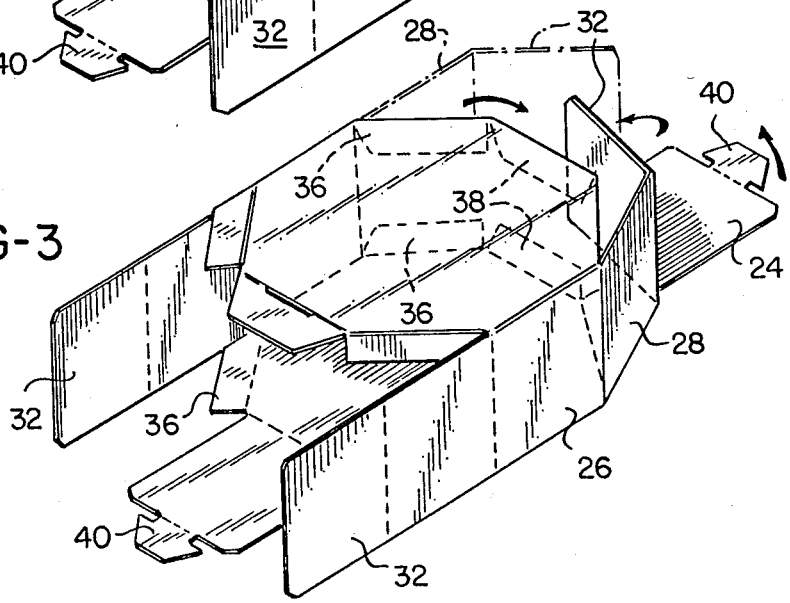
FIG. 3 illustrates the closure of one end of the erected box.

In this knocked-down configuration the box is shipped to a packager, who then moves the top wall 12 to a position overlying the bottom wall 14, as shown in FIG. 2 of the drawings, and thereafter folds the wings 36 at one end of the box inwardly to the position shown in FIG. 3 of the drawings.

Figure 4:
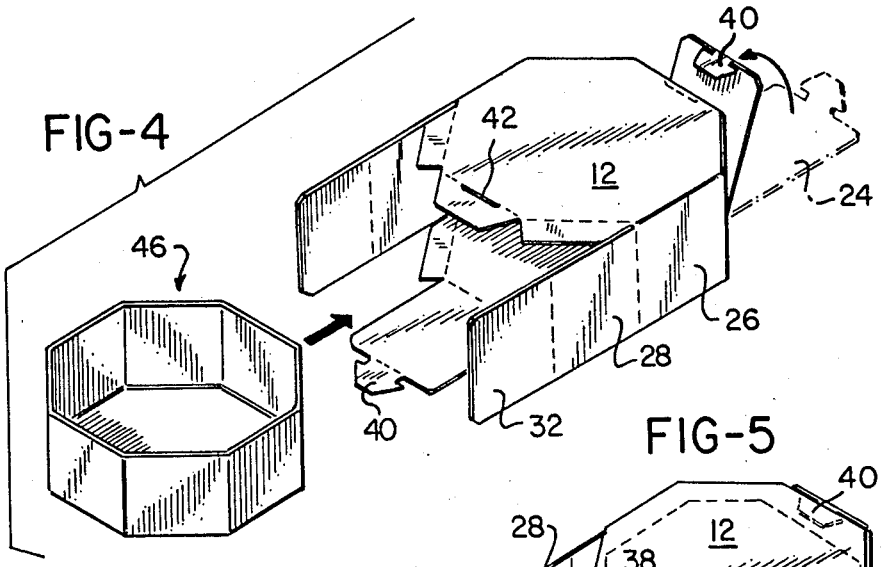
FIG. 4 depicts the final step of closing the first end of the box and the insertion into the partially completed box of a product to be packaged therein.
Figure 5:
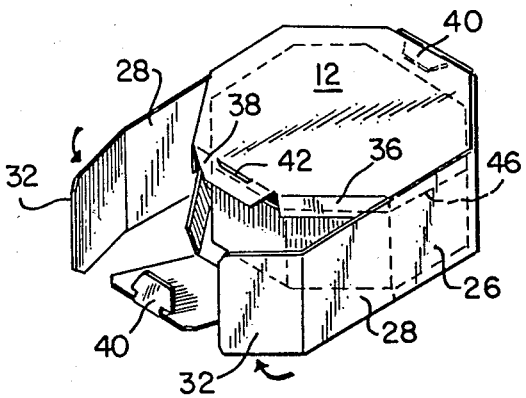
FIGS. 5, 6, 7 and 8 depict sequentially the final closure of the box after insertion of the product to be packaged therein.
Figure 6:
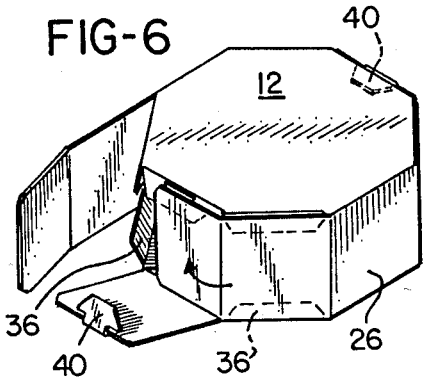
Figure 7:
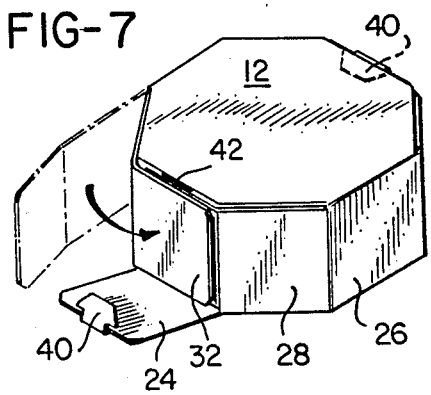
Figure 8:
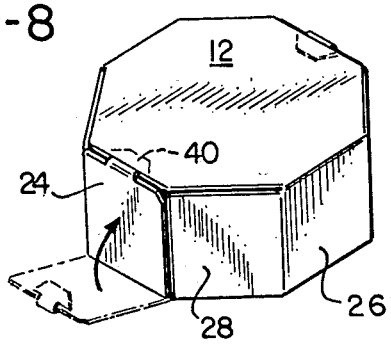

Next, the wall panels 28 and 32 at that end of the box, the right-hand end as seen in FIG. 3 of the drawings, are folded inwardly, the extension 38 at that end is folded downwardly and the wall panel 24 at that end is folded upwardly as shown in FIG. 4 of the drawings and its locking tab 40 inserted into the opposing slot 42, thus completing one end of the box.

Next, the product to be packaged, shown in FIG. 4 of the drawings as an eight-sided glass dish 46, is inserted into the left-hand, open end of the partially completed box and, as seen in FIGS. 5, 6, 7 and 8 of the drawings, the procedure performed on the right-hand end of the box is performed on the left-hand end to close the package with the product 46 enclosed therein.

With this construction it will be seen that the box can be shipped from the manufacturer to the packager in a flattened, knocked-down condition, quickly erected by the packager, the product inserted and the box closed to provide a package which is virtually impossible to inadvertently open and discharge its contents.

As noted above, with the construction shown in FIGS. 1 through 10 of the drawings, it is virtually impossible for the interlocked components to disengage and permit the box contents to be damage.. However, if the product packaged is particularly heavy and subjected to rough handling, in some instances the wall panels 28 and 32 may tend to slip outwardly. To prevent this occurrence the embodiment of FIGS. 11 and 12 of the drawings may be utilized.

Figure 11:
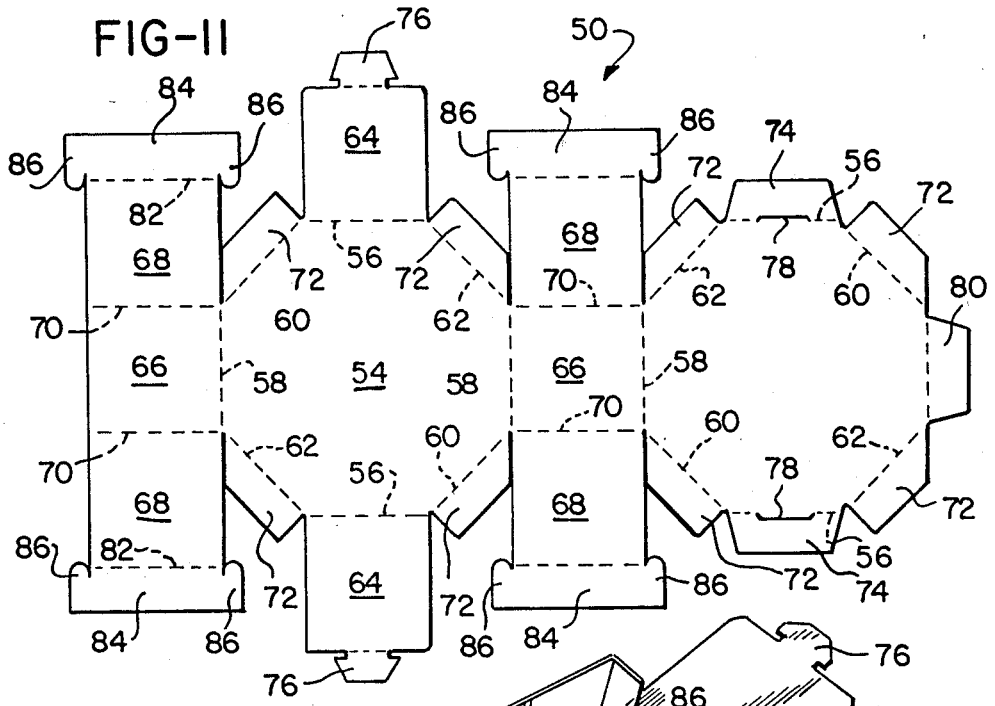
FIG. 11 shows a box blank from which a second preferred embodiment of the invention is constructed.

The box 50 shown in FIG. 11 includes top and bottom walls 52 and 54 having first and second opposing pairs of sides 56 and 58 and third and fourth pairs of opposing sides 60 and 62. Additionally, rectangularly-shaped wall panels 64 are joined to the bottom wall 54 and a second pair of substantially rectangular wall panels 66 are joined to the bottom wall 54 along its sides 58. Additional wall panels 68, also of substantially rectangular shape, are joined along their inner edges 70 to the wall panels 66.

Also, similarly to the embodiment of FIGS. 1 through 10, the box 50 is provided with substantially trapezoidally-shaped wings 72, trapezoidally-shaped extensions 74 on the top wall 52, locking tabs 76, complementary slots 78 formed along the first pair of sides 56 of the top wall 52, and a glue flap 80.

However, unlike the previous embodiment, the fourth wall panels 68 have joined thereto along their outer edges 82 locking flaps 84, each having pairs of ears 86.

With this construction, and as shown in FIGS. 12 and 13 of the drawings, after the manufacturer's joint has been formed between the glue flap 80 and an inner surface of a wall panel 66 and the top wall 52 moved over into position above the bottom wall 54, the wings 72 on one end of the box are folded inwardly and the ears 86 are locked over edges 88 of the wing 72, so that when the wall panels 64 are bent upwardly and their locking tabs 76 inserted in the complementary slots 78, the wall panels 68 cannot be moved from their closed position without tearing the box material.

With the construction of FIGS. 11 and 12, therefore, added protection is provided against inadvertent disengagement of the box components to provide a package of maximum security and product protection.

While the articles herein described constitute preferred embodiments of the invention, it is to be understood that the invention is not limited to these precise articles and that changes may be made therein without departing from the scope of the invention which is defined in the appended claims.

What is claimed is:

1. A box comprising:

polygonal top and bottom walls of substantially the same size and shape, said top and bottom walls each having an even number of sides greater than four, including a first and second opposing pairs of sides, a first pair of substantially rectangular wall panels each joined along first edges thereof to said first opposing sides of said bottom wall, a second pair of wall panels of substantially the same size and shape as said first wall panels each joined along first edges thereof to said second opposing sides of said bottom wall, additional wall panels equal in number to at least the number of said sides minus four, interconnected to said bottom wall and of substantially the same size and shape as said first and second wall panels, said top wall being joined along one of said second sides thereof to a second edge of one of said second wall panels opposite said first edge thereof, a flap joined to said top wall along a second of said second sides thereof, and locking tabs joined to said first wall panels along second edges thereof opposite said first edges thereof.

2. The box of claim 1 further comprising means defining slots along said first opposing sides of said top wall complementary to said locking tabs.

3. The box of claim 2 wherein said additional wall panels are joined to lateral edges of said second wall panels.

4. The box of claim 3 further comprising wings joined along edges thereof to sides of said top and bottom walls other than said first and second sides thereof.

5. The box of claim 4 further comprising extensions joined along edges thereof to said first opposing sides of said top wall.

6. The box of claim 5 wherein said wings are substantially trapezoidal in shape.

7. The box of claim 6 wherein said wings are joined along their major bases to said sides of said top and bottom walls.

8. The box of claim 7 wherein said flap is adhesively secured to one of said second side walls with a second side of said top wall substantially coincident with an edge of said second side wall opposite said first edge thereof.

9. The box of claim 8 wherein said wall panels are equal in number to a number of sides of said top and bottom walls plus two.

10. The box of claim 9 wherein said top and bottom walls are octagonal in shape.

11. The box of claim 10 wherein said box is formed from a blank consisting of a single sheet of corrugated cardboard.

12. The box of claim 4 further comprising locking ears engageable with portions of said wings.

13. The box of claim 12 further comprising extensions joined along edges thereof to said first opposing sides of said top wall.

14. The box of claim 13 wherein said flap is adhesively secured to one of said second side walls with a second side of said top wall substantially coincident with an edge of said second side wall opposite said first edge thereof.

15. The box of claim 14 wherein said top and bottom walls are octagonal in shape.

16. The box of claim 15 wherein said box is formed from a blank consisting of a single sheet of corrugated cardboard.

17. A box comprising:

substantially identical octagonal top and bottom walls, a first pair of substantially rectangular wall panels each joined along inner edges thereof to first opposing sides of said bottom wall, locking tabs connected to outer edges of said first wall panels opposite said inner edges thereof, a second pair of substantially rectangular wall panels each joined along inner edges thereof to second opposing sides of said bottom will, third pairs of substantially rectangularly wall panels joined along lateral edges thereof to lateral edges of said second wall panels extending substantially perpendicularly with respect to said inner edges thereof, flaps having locking ears adjacent opposite ends thereof joined to said third pairs of wall panels along outer lateral edges thereof, substantially trapezoidally-shaped wings joined at their major bases to opposing third and fourth pairs of sides of said top and bottom walls, said ears being engageable with edges of said trapezoidally-shaped wings, substantially trapezoidally-shaped extensions joined along their major bases to first sides of said top wall, means defining slots along said second opposing sides of said top wall complementary to said locking tabs, a substantially trapezoidally-shaped glue flap joined along its major base to a first one of said second sides of said top wall, said top wall being joined along a second of said second side walls thereof opposite said glue flap to one of said second wall panels, means adhesively securing said glue glap to one of said second wall panels with said one of said second sides of said top wall being substantially coincident with an edge of said second side wall to which said glue flap is joined opposite said first edge thereof, and said box being formed from a single sheet of corrugated cardboard.

18. A box comprising;

substantially identical octagonal top and bottom walls, a first pair of substantially rectangular wall panels each joined along inner edges thereof to first opposing sides of said bottom wall, locking tabs connected to outer edges of said first wall panels opposite said inner edges thereof, a second pair of substantially rectangular wall panels each joined along inner edges thereof to second opposing sides of said bottom wall, third pairs of substantially rectangular wall panels joined along lateral edges thereof to lateral edges of said second wall panels extending substantially perpendicularly with respect to said inner edges thereof, fourth pairs of wall panels of substantially rectangular shape joined along inner edges thereof to outer edges of said third pairs of wall panels, substantially trapezoidally-shaped wings joined at their major bases to opposing third and fourth pairs of sides of said top and bottom walls, substantially trapezoidally-shaped extensions joined along their major bases to said first sides of said top wall, means defining slots along said second opposing sides of said top wall complementary to said locking tabs, a substantially trapezoidally-shaped glue flap joined along its major base to one of said second sides of said top wall, said top wall being joined along a second one of said second sides thereof opposite said glue flap to one of said second wall panels, means adhesively securing said glue flap to one of said second wall panels with said one of said second sides of said top wall being substantially coincident with an edge of said second side wall to which said glue flap is joined opposite said first edge thereof, and said box being formed from a single sheet of corrugated cardboard.

* * * * *